US006230937B1

(12) United States Patent
Johnson et al.

(10) Patent No.: US 6,230,937 B1
(45) Date of Patent: May 15, 2001

(54) DISPENSING OUTLET ASSEMBLY

(75) Inventors: David Johnson, Northumberland; Julie Hatch, London; Andrew Shilton, London; Colin Purdey, London; Andrew C Streeter, Saffron Walden; Simon Ogle, Saffron Walden; Heather Kendle, Saffron Walden, all of (GB)

(73) Assignee: United Distillers & Vintners (HP) Limited (GB)

( * ) Notice: Subject to any disclaimer, the term of this patent is extended or adjusted under 35 U.S.C. 154(b) by 0 days.

(21) Appl. No.: 09/202,513

(22) PCT Filed: Jun. 13, 1997

(86) PCT No.: PCT/GB97/01597

§ 371 Date: Sep. 20, 1999

§ 102(e) Date: Sep. 20, 1999

(87) PCT Pub. No.: WO97/48617

PCT Pub. Date: Dec. 24, 1997

(30) Foreign Application Priority Data

Jun. 15, 1996 (GB) ..... 9612563

(51) Int. Cl.[7] ..... B65D 47/02

(52) U.S. Cl. ..... 222/147; 251/22

(58) Field of Search ..... 222/147, 148, 222/190; 215/21, 22, 252, 262

(56) References Cited

U.S. PATENT DOCUMENTS

| | | | | |
|---|---|---|---|---|
| 2,975,925 | * | 3/1961 | Chambers | 215/21 |
| 3,073,469 | * | 1/1963 | Towns | 215/21 |
| 4,458,817 | * | 7/1984 | Guala | 215/21 |
| 5,743,437 | * | 4/1998 | Moore et al. | 222/147 |
| 5,924,606 | * | 7/1999 | Huizing | 222/147 |

* cited by examiner

*Primary Examiner*—Philippe Derakshani
*Assistant Examiner*—Thach H. Bui
(74) *Attorney, Agent, or Firm*—Andrus, Sceales, Starke & Sawall

(57) ABSTRACT

A dispensing outlet assembly for a connection to a beverage container such as a bottle, comprises a body having an inlet for connection to the container, and a dispensing outlet through which beverage is dispensed from the container. A flow passage between the inlet and the outlet contains a ball-type non-return valve and an annular color element through which beverage dispensed from the container passes so as to impart a color to the beverage as it is dispensed.

13 Claims, 3 Drawing Sheets

DISPENSING OUTLET ASSEMBLY

Figure 1:
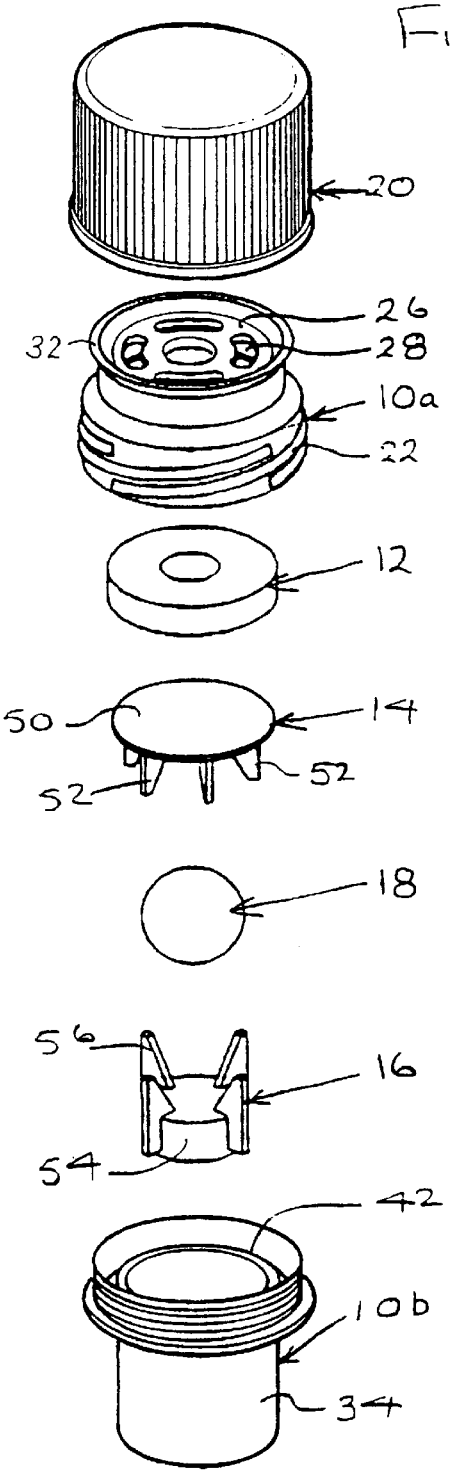

This invention relates to a dispensing outlet assembly through which liquid in a container is dispensed. The invention is particularly, but not exclusively, concerned with a dispensing outlet assembly for the dispensing of a beverage from a container such as a bottle.

It is an object of the present invention to provide a dispensing outlet assembly having a novel effect.

According to a first aspect of the present invention, there is provided a dispensing outlet assembly for connection to a liquid container, said assembly comprising (a) a body having (i) an inlet for connection to the container, (ii) a dispensing outlet through which liquid is dispensed from the container, and (iii) a flow passage between the inlet and the outlet; and (b) at least one modifier for modifying at least one property of the liquid being dispensed, said at least one modifier being disposed in the flow passage in the body so as to be contacted by the liquid passing in use from the inlet to the dispensing outlet, whereby liquid having at least one property which is different to that of the liquid in the container is dispensed.

Said at least one modifier is preferably one which is arranged to induce an organoleptic change in the liquid, and may be selected from one or more of the following:

1. An additive for changing the colour of the liquid,
2. An additive for changing the flavour of the liquid,
3. An additive for changing the mouthfeel of the liquid,
4. An additive for changing the odour of the liquid,
5. An additive for changing a light transmission characteristic of the liquid e.g. opacity.
6. A pH modifier which may be arranged to induce any desired organoleptic change in the liquid, for example a colour, flavour or mouthfeel change.
7. A decolouriser (e.g. activated charcoal) for decolouring a coloured liquid,
8. A deodoriser (e.g. activated charcoal) for deodorising an odiferous material.

Most preferably, the dispensing outlet assembly includes means for preventing liquid which has already contacted said at least one modifier from returning to the container. Such means may be selected from any one or more of the following:

1. A non-return valve; and
2. A recess disposed between said at least one modifier and the inlet of the body so as to retain liquid which has contacted the modifier in order to prevent such liquid from returning to the inlet.

According to a second aspect of the present invention, there is provided a liquid container fitted with a dispensing outlet assembly according to said first aspect of the present invention.

The liquid may be any desired liquid, but is preferably a beverage, more particularly an alcohol-containing beverage, e.g. a spirit-based liquor.

The liquid container preferably takes the form of a bottle or other at least partially transparent container whose liquid contents can be viewed. This is particularly preferable in the case where said at least one modifier serves to modify the visual appearance, particularly the colour or other light transmission characteristic of the liquid.

Most preferably, the body of the assembly is formed of an opaque material so that the presence of said at least one modifier is not visually apparent.

The body of the dispensing outlet assembly may be arranged to be secured to the container in any desired way, e.g. by means of a snap- or press-fit connection.

It is therefore possible in accordance with the present invention to provide a variety of dispensing outlet assemblies which can be fitted as desired to a container having a certain type of liquid therein so that the properties of the liquid being dispensed from the container can be selected at will.

In the case where said at least one modifier is an additive which imparts a colour change to a colourless liquid or a colour change to an already coloured liquid, said modifier may comprise a dye which is in particulate or liquid form. It is particularly preferred for such modifier to be formed by co-spraying dye with one or more excipients which are soluble or dispersible in the liquid, for example one or more of cellulose particles (e.g. microcrystalline cellulose), sugar particles (e.g. dextrose) and gum particles (e.g. a dextrin such as maltodextrin). In the case where the dye is in particulate form and is to be wetted with the liquid, this makes the dye readily wettable so that the colour can be drawn through the particulate dye mass when contacted by the liquid.

In a particularly convenient embodiment, which is used for colouring a beverage, e.g. an alcoholic beverage such as a spirit-based liquor, the modifier may comprise an edible dye (e.g. carmine or an azo dye approved for use in foodstuffs) and one or more of the above-mentioned excipients.

Said at least one modifier may be contained in an apertured bag in said flow passage.

In one convenient embodiment, the apertured bag is a perforated bag. The material of the bag is preferably a porous, woven or spun-bonded polyolefin (e.g. polypropylene or polyethylene) which is heat-sealable. The perforations in the bag preferably have a size of 40 $\mu$m to 90 $\mu$m, more preferably about 70 $\mu$m. With such an arrangement, the bag is arranged to be soaked with the liquid as it is being dispensed so that some of the modifier is leached from the bag and modifies the liquid being dispensed.

In another convenient embodiment, the apertured bag is arranged to be acted upon by a part which is movable when the assembly is tilted so as to cause release of a quantity of said at least one modifier from the bag into the flow path. Such a bag may has a capillary-type aperture or it may have an aperture which is normally closed but which opens when the contents of the bag are pressurised by said part.

In a further embodiment, the modifier is contained in a reservoir and pump means, eg. an electrical pump, is provided for dispensing the modifier from the reservoir.

Figure 2:
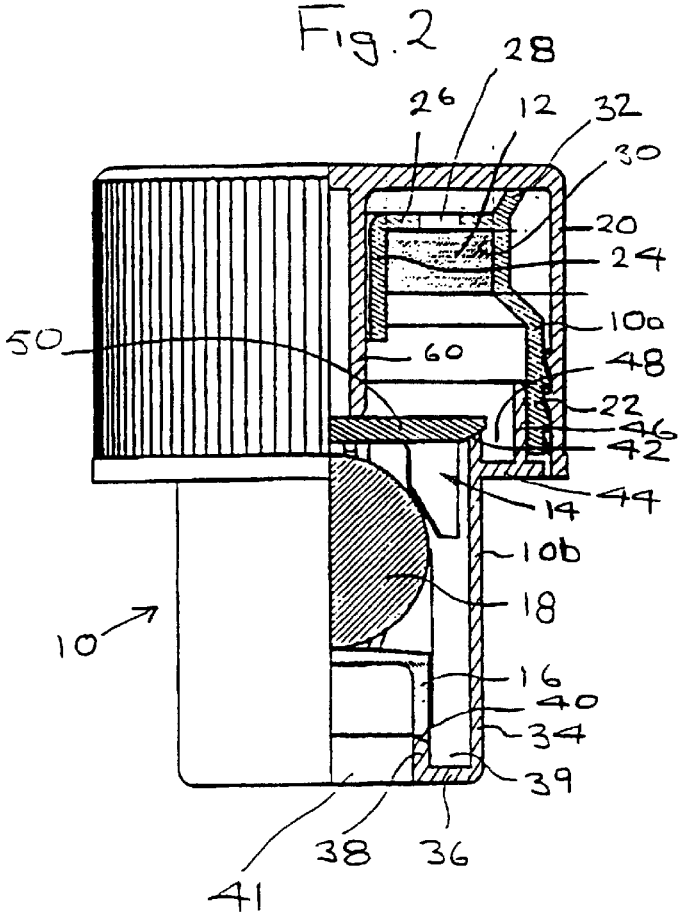
Figure 3:
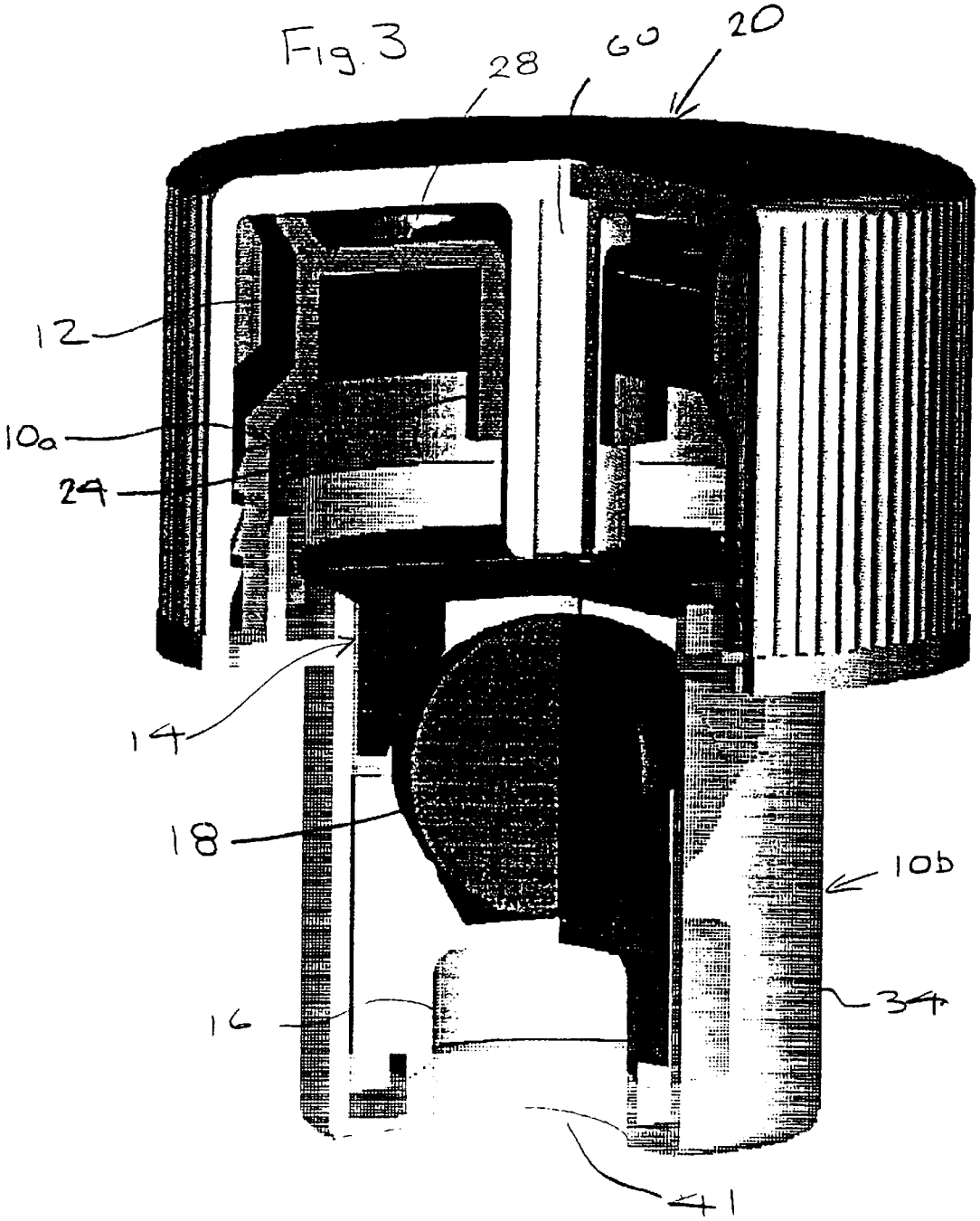
Figure 4:
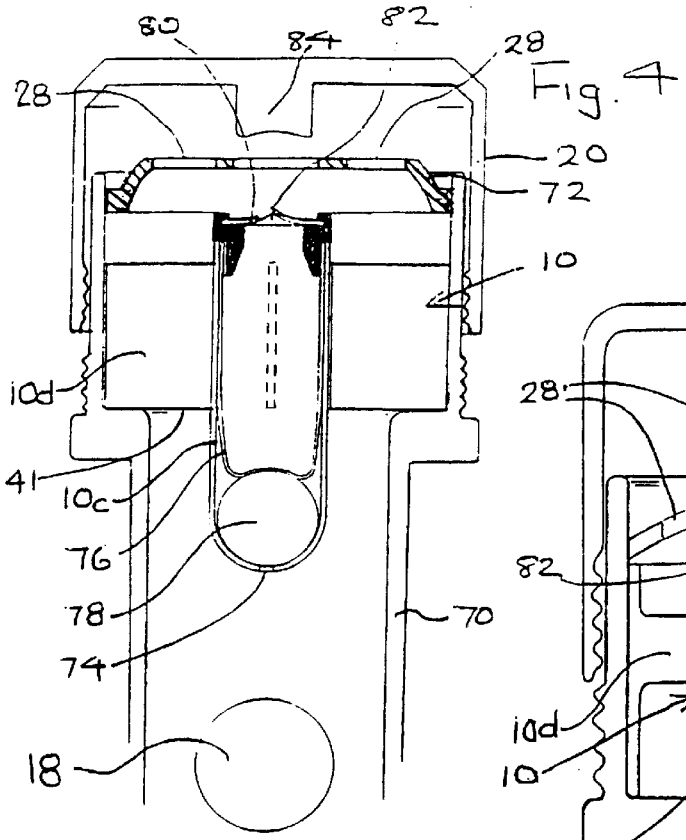
Figure 5:
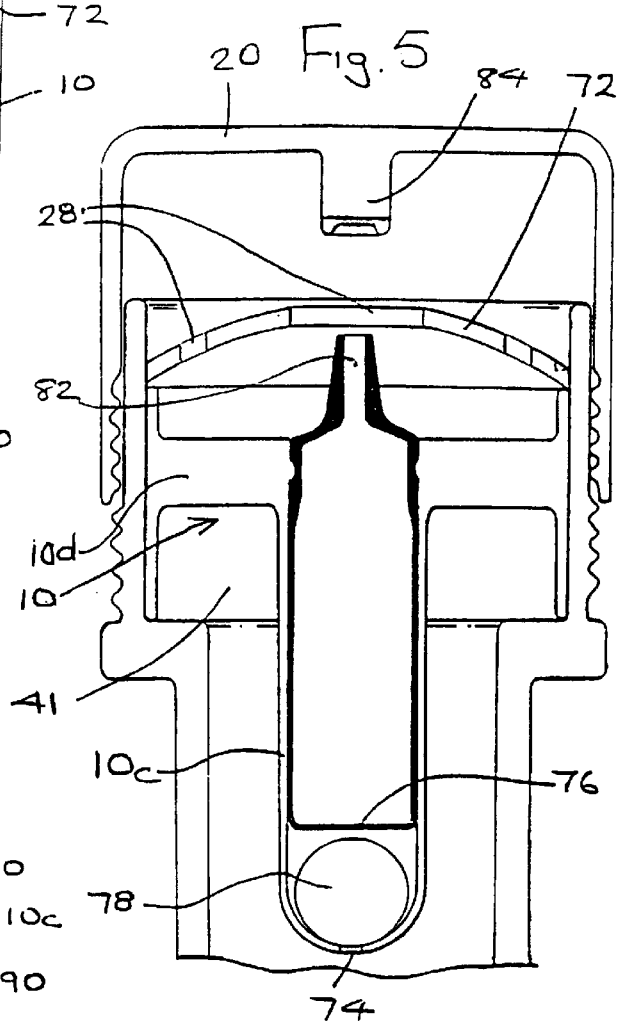
Figure 6:
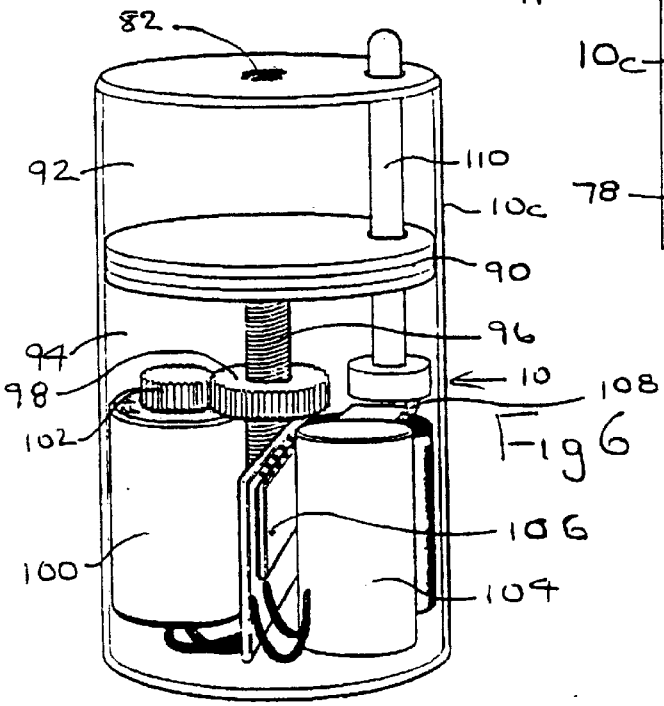

An embodiment of the present invention will now be described, by way of example, with reference to the accompanying drawings, in which:

FIG. 1 is an exploded perspective view of a dispensing outlet assembly according to one example of the present invention, FIG. 2 is a side elevation shown partly in section of the assembly illustrated in FIG. 1, FIG. 3 is a perspective view, also shown partly in section, of the assembly of FIGS. 1 and 2, FIG. 4 is a schematic view of the top of a bottle fitted with another example of dispensing outlet assembly according to the present invention, FIG. 5 is a schematic view of the top of a bottle fitted with a further example of dispensing outlet assembly according to the present invention, and FIG. 6 is a schematic perspective view of a still further example of dispensing outlet assembly according to the present invention.

Referring now to FIGS. 1 to 3 of the drawings, the dispensing outlet assembly comprises a multi-part body indicated generally by arrow 10 and composed of upper and lower body parts 10*a* and 10*b*. The assembly further includes a modifier in the form of an annular colouring element 12, an upper valve member 14, a lower valve member 16, a weight 18 in the form of a glass ball, and a screwcap 20.

The upper body part 10*a* is molded from a suitably opaque synthetic plastics material (e.g. a tinted or filled polycarbonate). The upper body part 10*a* comprises an externally screw-threaded skirt 22, an internal central annular wall 24 and an upper flange 26 having a series of arcuate slots 28 therethrough at a location disposed between the skirt 22 and the annular wall 24. Thus, there is defined an annular recess 30 into which the slots 28 open. The annular recess 30 receives the annular colouring element 12. The flange 26 is surrounded by an upwardly and outwardly directed annular pouring lip 32. The slots 28 define a dispensing outlet of the assembly.

The lower body part 10*b* comprises a lower sleeve 34 formed at its lower end with an inwardly directed lower flange 36 having an upwardly directed inner annular collar 38 whose upper end is inclined to define a downwardly and outwardly flaring, frusto-conical valve seat 40. The sleeve 34, flange 36 and collar 38 together define an annular recess 39 which surrounds the collar 38 and which is disposed below the valve seat 40. An inlet 41 to the assembly is defined inwardly of the flange 36 and collar 38.

The upper end of the sleeve 34 defines an upper, frusto-conical valve seat 42 which flares outwardly and upwardly. At a location which is spaced a short distance below the upper valve seat 42, the lower body part 10*b* has a radially outwardly directed upper flange 44 with an upwardly directed annular collar 46 spaced outwardly of the sleeve 34. The upper end of the sleeve 34, the flange 44 and the collar 46 together define an upper annular recess 48 which is disposed below the upper valve seat 42.

The upper and lower body parts 10*a* and 10*b* are secured together, e.g. by frictional engagement between the outer surface of the collar 46 and the inner surface of the screw-threaded skirt 22.

The annular colouring element 12 comprises a mass of dye particles which have been co-sprayed with a mixture of water soluble or water dispersible gums and which is contained within an annular perforated bag (not shown) formed of a woven, heat-sealable polypropylene cloth having pores over the whole of its surface, the pores having a diameter of about 70 $\mu$m. In this particular embodiment, the annular colouring element is a 0.36 g tablet containing 100 mg of FD&C Red 40 (an azo dye), and 0.26 g of an excipient mixture of microcrystalline cellulose, maltodextrin and dextrose, giving a dye: excipients weight ratio of 1:2.6.

The upper valve member 14 comprises a horizontal valve disk 50 having at its underside a frusto-conically chamfered outer edge which cooperates with the upper valve seat 42. The upper valve member 14 further comprises a multiplicity of legs 52 extending downwardly from the disk 50 to define a cage which embraces an upper region of the glass ball 18. The ball 18 is disposed within the sleeve 34. With the screwcap 20 removed, the valve member 50 is free to slide axially of the sleeve 34 from a lower position (as shown in FIG. 2) where it seals against the valve seat 42 to an upper position in which it abuts against the lower end of the annular wall 24 of the first body part 10*a*. The length of each leg 52 is such that the lower end thereof remains within the sleeve 34 even when the upper valve member 14 is in its upper position. Although not shown in the drawings, the upper surface of the disk 50 is of convex domed shape to prevent liquid collecting on the surface thereof. The upper valve member 14 and upper valve seat 42 together define an upper non-return valve.

The lower valve member 16 comprises an inverted, cup-shaped element 54 whose annular lower edge is frusto-conically shaped to correspond with that of the lower valve seat 40. A series of legs 56 extend upwardly from the element 54 to define a cage which embraces the lower region of the ball 18. The lower valve element 16 is freely slidable within the sleeve 34 so as to be movable into and out of a lower position (as shown in FIG. 2) where it seals against the lower valve seat 40. The lower valve member 16 and the lower valve seat 40 together define a lower non-return valve.

The screwcap 20 is formed with a central, downwardly directed post 60 of cruciform cross-section. The post 60 engages within the inner annular wall 24 of the upper body part 10*a* so as to rest against the upper, domed surface of the valve disk 50, thereby to urge the latter into its lower position in which it seals against the upper valve seat 42. This action also causes a closing force to be applied to the lower valve member 16 via the legs 52, the ball 18 and the legs 56.

In use, the above-described assembly is forced into the neck of a transparent bottle containing a transparent, spirit-based liquor until the flange 44 rests against the lip of the bottle. The outer diameter of the sleeve 34 is such that it seals within the neck of the bottle.

When the screwcap 20 is un-screwed, the upper and lower valve members 14 and 16 are free to slide out of their sealing engagement with the respective upper and lower valve seats 42 and 40. When the bottle is tipped to dispense a measure of liquor from the dispensing outlet assembly, liquor from the bottle passes through the inlet 41. The weight of liquor against the underside of the lower valve member 16 causes it to move into a position in which the liquor from the bottle can flow past the valve seat 40 and along the sleeve 34, past the upper valve seat 42 and into the interior of the upper body part 10*a*. In this condition, the disk 50 of the upper valve member 14 contacts the lower edge of the inner annular wall 24 and prevents flow of liquor out of the assembly inwardly of the wall 24 i.e. it prevents flow of liquor through the space previously occupied by the post 60 of the screwcap 20.

It is at this stage that the liquor first contacts the annular colouring element 12. The annular colouring element 12 is permeable to the liquor so that the latter flows therethrough and leaves the assembly by way of one or more of the slots 28. The pouring lip 32 assists in preventing drips. During its passage through the annular colouring element 12, the colourless liquor from the bottle leaches out some of the soluble dye from the element 12 and becomes coloured (red in the case of carmine dye). Thus, the liquor undergoes a colour change from colourless to red upon passage through the dispensing outlet assembly.

When the bottle is tilted back to prevent further liquor from being dispensed, the upper and lower valve members 14 and 16 move back into their lower sealed positions to prevent liquor which has already been in contact with the colouring element 12 from flowing back into the bottle. As a further safeguard, liquor flowing back towards the bottle is trapped either in annular recess 48 or in annular recess 39 depending upon the location of the liquor within the assembly at the stage when the bottle is brought back to an upright position following dispensing. In this way, the risk of any coloured liquor flowing back into the bottle and thereby spoiling the desired effect is minimised.

The amount and physical condition of the dye in the element 12 is so arranged that it will effectively colour the liquor being dispensed in measures over a period of time until the bottle is empty. For a 70 cl bottle, it is considered that a quantity of 0.1 g of the above-described dye is all that is required in the colouring element 12.

The ball 18 acts as a mass to facilitate the required opening and closing of the valves within the assembly. This is advantageous particularly in the case of liquids containing dissolved solids, e.g. sugar, since liquid within the assembly can evaporate in time to leave a sticky deposit which may interfere with correct operation of the valves, particularly the upper valve. Shaking the bottle gently with the screwcap 20 removed enables the weight of the ball 18 to be used to release a stuck upper valve member. The cruciform section of the post 60 in the screwcap 20 also assists in breaking any sticky deposit between the post 60 and the wall 24 when the screwcap 20 is unscrewed.

In the embodiment of FIG. 4, similar parts to those of the embodiment of FIGS. 1 to 3 are according the same reference numerals. The dispensing outlet assembly is fitted into the neck of a bottle 70 (only partly shown) having screwcap 20. The assembly comprises body 10 in the form of a tubular body part 10*c* and four radial support ribs 10*d* which support the tubular part 10*c* centrally within the neck of the bottle 70. Spaces between the lower edges of the support ribs 10*d* define inlet 41, whilst a perforated insert 72 in the upper end of the neck defines outlet 28.

The base of the tubular body part 10*c* is hemispherical and has an aperture 74 therethrough. The body part 10*c* contains a flexible bag 76 and a ball 78, the latter being located in the hemispherical base. The bag 76 has an open top which is closed by a resilient diaphragm 80 having a slit therein defining a normally closed outlet 82 to the bag 76.

The outlet 82 is directly aligned with a central opening in the insert 72. A return spring (not shown) serves to bias the bag 76 and bail 78 downwardly into the position shown in FIG. 4. The bag 76 forms a reservoir for liquid colour which is to be dispensed together with liquid from the bottle 70.

The screwcap 20 has an internal, downwardly-extending projection 84 which is arranged to pass through the insert 72 and to engage the diaphragm 80 so as to maintain the outlet 82 closed when the screwcap 20 is fully tightened onto the neck of the bottle 70. In FIG. 4, the screwcap 20 is shown in a partly loosened condition.

In use, when the screwcap 20 is removed and the bottle 70 is tilted to dispense some of the liquid contents thereof, the liquid flow out of the bottle between the ribs 10*d* and through the outlet 28 in the insert 72. At the same time, tilting of the bottle causes the ball 78 and any liquid from the bottle which has entered the tubular body part 10*c* through the aperture 74 to collapse the bag 76 partially and pressurise the liquid colour so as to force it from the bag 76 through the outlet 82 defined by the slit which opens under these conditions. In this way, the liquid colour is dispensed together with liquid from the bottle 70 and so that liquid coloured by the liquid colour flows from the bottle.

When the bottle 70 is returned to an upright condition, the spring and the action of gravity on the ball 78 serve to cause the pressure on the liquid in the bag 76 to be relaxed so that the outlet 82 can close. The bag 76 may readopt the condition shown in FIG. 4. Alternatively, the arrangement may be such that the bag 76 remains in a partially collapsed state ready for further collapsing and pressurising by the spring and the ball 78 the next time the bottle 70 is tilted with the screwcap 20 removed. Any liquid which may have entered the body part 10*c* can drain back into the bottle 70 through the aperture 74. The positioning of the outlet 82 centrally of the neck of the bottle and directly facing the mouth of the bottle 70 ensures that any liquid colour which has passed through the outlet 82 will be carried through the mouth of the bottle 70 by the surrounding flow of liquid from the bottle 70. This minimises the risk of liquid colour flowing back down into the bottle 70 when the latter is returned to an upright condition.

The embodiment of FIG. 5 is very similar to that of FIG. 4, except that, in this case, bag 76 has a permanently open capillary-type outlet 82 through which colour liquid is forced when the bottle 70 is tilted. In this case, the bag 76 is arranged to stay partially collapsed after the bottle 70 is returned to an upright position after liquid has been dispensed. This is done to ensure that the capillary outlet 82 remains filled with liquid colour.

In FIG. 6, a motorised pump-type dispensing outlet assembly is illustrated. In this embodiment, the tubular body part 10*c* takes the form of a cylinder housing a piston 90 which divides the tubular body part into an upper reservoir 92 for dye in gel form and a lower chamber 94. The radial ribs 10*d* are provided but are not illustrated in FIG. 6. A screw-threaded rod 96 is mounted in the chamber 94 and engages the underside of the piston 90. The rod 96 has an internally screw-threaded gear ring 98 mounted thereon. An electric motor 100 in the chamber 94 drives the gear ring 98 via a drive gear 102 which is mounted on the output shaft of the motor 100 and which meshes with the gear ring 98. A battery 104 powers the motor 100 under the control of a microprocessor 106 which is connected to a sensor (not shown). The sensor senses when liquid is flowing past the body part 10*c* upon tilting of the bottle and causes the motor to be energised and senses when flow has stopped to de-energise the motor 100 via the microprocessor 106. An override switch 108 operated by a plunger 110 extending through the top of the body part 10*c* for engagement by the screwcap 20 (not shown in FIG. 6) serves to ensure that the motor 100 cannot be energised when the screwcap 20 is on the bottle 70.

What is claimed is:

1. A dispensing outlet assembly for connection to a liquid container, said assembly comprising (a) a body having (i) an inlet for connection to the container, (ii) a dispensing outlet through which liquid is dispensed from the container, and (iii) a flow passage between the inlet and the outlet; and (b) at least one modifier for modifying at least one property of the liquid being dispensed, said at least one modifier being disposed in the flow passage in the body so as to be contacted, by the liquid passing in use from the inlet to the dispensing outlet, wherein said at least one modifier is selected from an additive for changing the colour of the liquid being dispensed and an additive for changing the flavour of the liquid being dispensed whereby, in use, liquid having a colour and/or flavour which is different to that of the liquid in the container is dispensed, and wherein means are provided for preventing liquid which has already contacted said at least one modifier from returning to the container.

2. The assembly as claimed in claim 1, wherein said at least one modifier further includes one or more of an additive for changing the mouthfeel of the liquid, an additive for changing the odour of the liquid, an additive for changing a light transmission characteristic of the liquid, a pH modifier which is arranged to induce any desired organoleptic change in the liquid, a decolouriser for decolouring a coloured liquid, and a deodoriser for deodorising an odiferous material.

3. The assembly as claimed in claim 1, wherein the preventing means is a non-return valve and/or a recess disposed between said at least one modifier and the inlet of the body so as to retain liquid which has contacted the modifier in order to prevent such liquid from returning to the inlet.

4. The assembly as claimed in claim 1, wherein said at least one modifier is contained in an apertured bag in said flow passage.

5. An assembly as claimed in claim 4, wherein said apertured bag is a perforated bag.

6. The assembly as claimed in claim 4, wherein the bag is arranged to be acted upon by a part which is movable when the assembly is tilted so as to cause release of a quantity of said at least one modifier from the bag into the flow path.

7. The assembly as claimed in claim 1, including reservoir means for said at least one modifier, and pump means for dispensing said at least one modifier from said reservoir.

8. The assembly as claimed in claim 1, wherein the body is formed of an opaque material.

9. The liquid container fitted with a dispensing outlet assembly as claimed in claim 1.

10. A dispensing outlet assembly for connection to a liquid container, said assembly comprising (a) a body having (i) an inlet for connection to the container, (ii) a dispensing outlet through which liquid is dispensed from the container, and (iii) a flow passage between the inlet and the outlet, and (b) at least one modifier for modifying at least one property of the liquid being dispensed, said at least one modifier being disposed in the flow passage in the body so as to be contacted by the liquid passing in use from the inlet to the dispensing outlet whereby liquid having at least one property which is different to that of the liquid in the container is dispensed, wherein at least said one modifier is contained in an apertured bag in said flow passage.

11. The assembly as claimed in claim 10, wherein said apertured bag is a perforated bag.

12. The assembly as claimed in claim 10, wherein said bag is arranged to be acted upon by a part which is moveable when the assembly is tilted so as to cause release of a quantity of said at least one modifier from the bag into the flow path.

13. The assembly as claimed in claim 10, including reservoir means for said at least one modifier, and pump means for dispensing said at least one modifier from said reservoir.

* * * * *